US006648576B1

(12) United States Patent
Duell et al.

(10) Patent No.: US 6,648,576 B1
(45) Date of Patent: Nov. 18, 2003

(54) HYDRAULIC SYSTEM AND METHOD OF OPERATING SAME

(75) Inventors: Charles A. Duell, Crestline, OH (US); Thomas E. Pfeifer, Galion, OH (US)

(73) Assignee: McClain Industries, Galion, OH (US)

( * ) Notice: Subject to any disclaimer, the term of this patent is extended or adjusted under 35 U.S.C. 154(b) by 0 days.

(21) Appl. No.: 10/368,545

(22) Filed: Feb. 18, 2003

Related U.S. Application Data

(63) Continuation of application No. 10/117,815, filed on Apr. 8, 2002, now Pat. No. 6,547,505, which is a continuation of application No. 09/955,564, filed on Sep. 18, 2001, now abandoned, which is a continuation of application No. 09/570,882, filed on May 15, 2000, now Pat. No. 6,312,209.

(51) Int. Cl.[7] ..... B65F 3/02
(52) U.S. Cl. ..... 414/408
(58) Field of Search ..... 414/406, 408, 414/699

(56) References Cited

U.S. PATENT DOCUMENTS

| | | | | | |
|---|---|---|---|---|---|
| 4,230,359 | A | * | 10/1980 | Smith | 414/408 |
| 4,715,767 | A | * | 12/1987 | Edelhoff et al. | 414/408 |
| 5,890,865 | A | * | 4/1999 | Smith et al. | 414/408 |
| 5,954,470 | A | * | 9/1999 | Duell et al. | 414/525.6 |
| 6,158,945 | A | * | 12/2000 | Anderson et al. | 414/408 |
| 6,312,209 | B1 | * | 11/2001 | Duell et al. | 414/408 |
| 6,547,505 | B1 | * | 4/2003 | Duell et al. | 414/408 |

* cited by examiner

*Primary Examiner*—Joseph E. Valenza
(74) *Attorney, Agent, or Firm*—McDonnell Boehnen Hulbert & Berghoff

(57) ABSTRACT

An improved hydraulic system and method of operating same for waste collection vehicles is provided where a closed center valve in conjunction with a positive displacement pump is used without the need for increasing engine RPM, thus significantly reducing vehicle noise during operation of the hydraulic system.

3 Claims, 3 Drawing Sheets

HYDRAULIC SYSTEM AND METHOD OF OPERATING SAME

This is a continuation of application Ser. No. 10/117,815 filed on Apr. 8, 2002, now U.S. Pat. No. 6,547,505 which is a continuation of Ser. No. 09/955,564 filed on Sep. 18, 2001, now abandoned, which is a continuation of Ser. No. 09/570,882 filed on May 15, 2000 now U.S. Pat. No. 6,312,209.

BACKGROUND OF THE INVENTION

I. Field of Invention

This invention relates generally to systems and methods of activating hydraulic cylinders on waste collection vehicles. More particularly, our invention relates to an improved hydraulic system and method for lifting and loading waste materials into waste collection vehicles.

II. Discussion of the Prior Art

A conventional refuse collection vehicle includes a cab, a body for storing refuse positioned at the rear of the cab, and a container-handling mechanism, (such as a lift arm or boom connected to a container gripper), carried on a wheeled chassis adjacent either the cab or the body. With an automated vehicle, the container-handling mechanism is typically controllably actuated by pressurized fluid selectively directed by controls located at the operator's compartment within the cab. Conventionally, the container-handling mechanism includes pivoting forks or opposed gripping members carried at the end of the lifting arm(s) or boom which is extendable and retractable relative to the curb or pick-up side of the vehicle. When the vehicle is brought to a stop, the lifting arm(s) and the associated fork(s) or gripping members engage the container. The container is then elevated through coordinated movement of the lifting arm(s) and/or boom and forks, for example, to position the container adjacent or over a hopper located behind the cab to deposit the refuse. Typically, these refuse collection vehicles are controlled by a sophisticated computer system utilizing logic circuits.

Lifting and loading mechanisms that engage containers in the front of the waste collection vehicles, known as "front end loaders," are in common use. (Throughout this application, "front" or "forward" will be used to signify the cab-end of the vehicle while "back" or "rearward" will denote the opposite direction of the vehicle.) These mechanisms conventionally have two curved arms that clear the cab in front of the vehicle, connected to a pair of pivoting forks or other articulating member that fit into side or bottom pockets of a steel collection container. Other conventional mechanisms employ a triangular frame in front of the cab that locks into a triangle pocket on the rear face of a collection container. An example of a prior art front-end loader is described and illustrated in U.S. Pat. No. 5,954,470 to Duell et al. Other types of collection containers can be used, as well. Another example of a lifting assembly is shown in U.S. Pat. No. 4,715,767 to Edelhoff et al. Edelhoff discloses a lift arm arranged to pick-up the containers along the side of the cab, generically known as a "sideloader."

Waste collection vehicles are routinely used for collecting and transporting waste and recyclable materials discarded at both residential and commercial locations. The ubiquitous nature of these collection vehicles can negatively affect the reputation of companies that operate them and irritate the residential customers served by them. A major source of this irritation is the constant and repeated increased in noise level as the various hydraulic mechanisms on the vehicle are activated as the vehicle completes its route. Universally, waste collection vehicles use hydraulic systems to operate the lifting, dumping and compaction mechanisms. Operation of these hydraulic systems typically requires throttle advancement resulting in increased engine RPM, which translates into increased vehicle noise heard by those persons in proximity to the vehicle.

To waste collection companies operating waste collection vehicles, a key criterion is route time. The longer it takes to complete the route, the more expensive the operation. Time-savings on the order of minutes can have an enormous impact on operation costs. Moreover, approximately 50% of the route time is a result of operating the hydraulic systems on conventional waste collection vehicles. An improved hydraulic system and method of operation that would shorten the operation and route times would be a significant advantage in terms of time and expense. Likewise, the ability to operate hydraulic systems without the normally required increase in engine RPM would greatly reduce noise pollution, reduce fuel consumption and reduce air pollution. Our invention accomplishes these, as well as other goals.

Accordingly, one objective of our invention is to provide a method of activating hydraulic cylinders on waste collection vehicles that is more energy and time efficient.

Another object of the present invention is to provide an improved hydraulic system that replaces the conventional gear pump and open center valve with a close center value and a variable displacement pump.

Yet another object of the invention is to provide a more reliable and efficient waste collection vehicle that requires less maintenance at reduced operation costs. Another object is to provide an energy efficient method of cycling and emptying a refuse container using a front-end loader waste collection vehicle.

Still another object of our invention is to provide a method of cycling and emptying a refuse container without increasing engine RPM and that allows continuous and rapid movement of the refuse container throughout the cycle without the spillage normally associated with prior art methods.

Still other objects will be recognized upon reading the following disclosure.

SUMMARY OF THE INVENTION

In accomplishing the goals and objectives previously stated we have discovered and developed a method of activating hydraulic cylinders on a waste collection vehicle comprising activating an operator control in communication with a closed center control valve having multiple ports in a first setting of open and closed positions; repositioning spools in the valve to set the ports to a second setting using a control fluid and in response to activating the operator control; redirecting hydraulic fluid flow through the closed center valve in response to the changing port settings of the closed center valve using a positive displacement pump; directing the pressurized hydraulic fluid using the control valve to at least one hydraulic cylinder; and sensing a load applied to the hydraulic cylinder and adjusting the pressure applied to the hydraulic fluid by increasing or decreasing the flow from the positive displacement pump.

The hydraulic system we use to achieve our new method uses the unique combination of a close center valve and a positive displacement pump, where the valve is controlled not by the use of complicated electronic circuits and/or microprocessors, but instead using less complicated hydro-mechanical devices, such as compressed air actuators and pressure taps. Our unique valve/pump combination allows operation of the hydraulics on a waste collection vehicle without requiring an increase in engine RPM. Likewise, and the associated increase in engine noise common to the operation of conventional hydraulic systems found on prior art refuse vehicles is not experienced using our invention.

Applying our invention to a specific type of waste collection vehicle, namely a front-end loader, we have developed a new method of cycling and emptying a refuse container, which is sometimes referred to as a carry-can. This new method of cycling and emptying a refuse container comprises, activating an operator control in communication with a control valve; directing pressurized hydraulic fluid using the control valve to at least one first hydraulic cylinder connected to at least one arm of a front-end loader vehicle; raising the arm and refuse container in a continuous upward motion; triggering a position sensor in communication with the control valve as the arm rises to a first predetermined position; directing pressurized fluid using the control valve to at least one second hydraulic cylinder connected to an articulating member which is attached to the arm and in communication with the refuse container in response to the triggering of the position sensor; continuously rotating the articulating member and the refuse container while continuously raising the arm and the refuse container up and above the refuse vehicle; and emptying the refuse container into a hopper located on the refuse vehicle.

BRIEF DESCRIPTION OF THE DRAWINGS

The novel features of the invention are set forth in the claims. Preferred embodiments of the various forms of our inventions, however, together with further objects and attendant advantages, will be best understood by reference to the following description taken in connection with the accompanying drawings in which:

DESCRIPTION OF PREFERRED EMBODIMENTS

Figure 2:
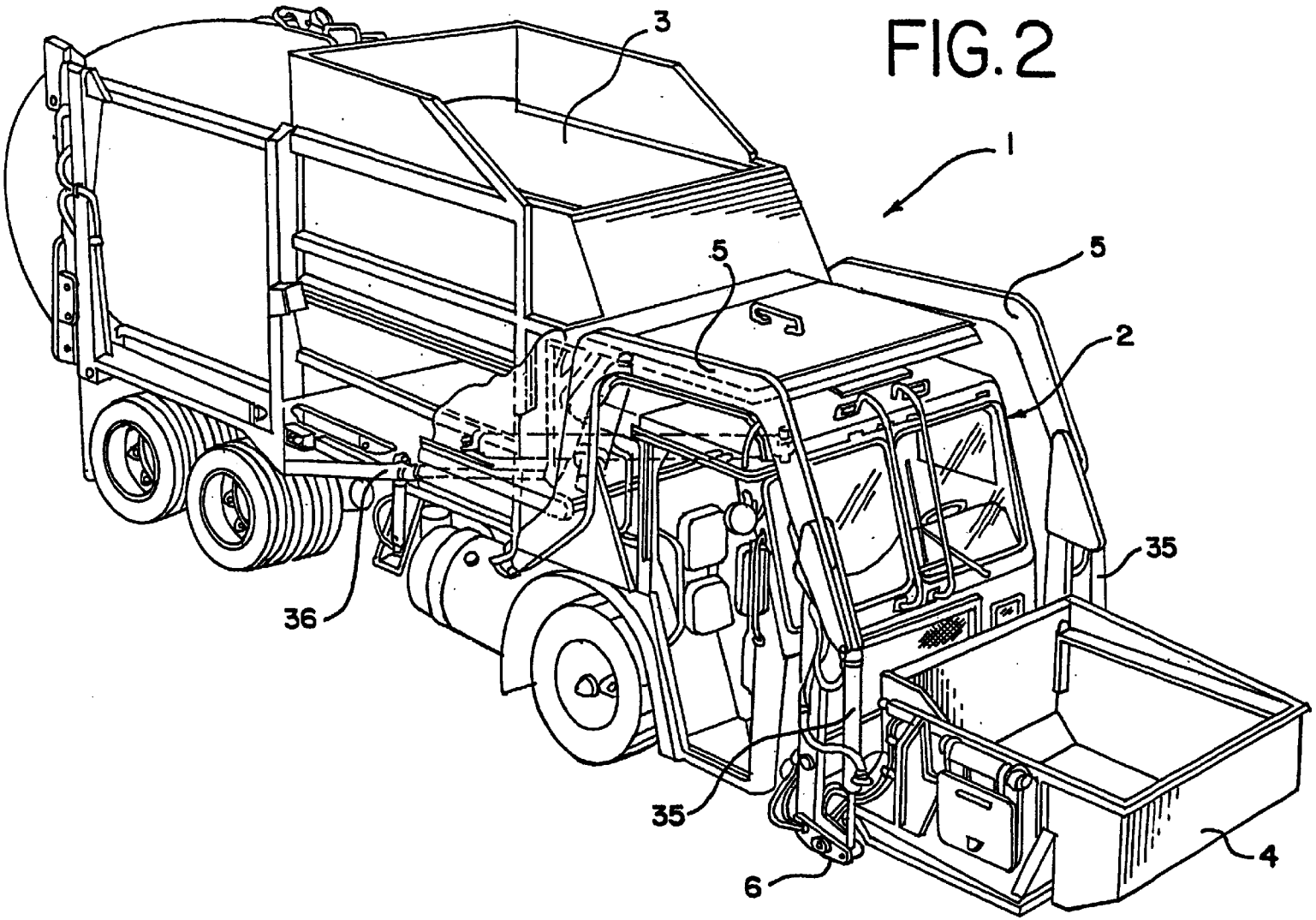
FIG. 2 is a perspective view of a front-end loader waste collection vehicle.

To activate the hydraulic system of our invention and to perform the several methods of our invention, an operator control is required. Although the specific design of the operator control is not critical to our invention, a preferred design is one that is commonly known as a compressed air valve set up to act as a "dead man's switch." Such a design requires the vehicle operator to apply a constant force on the control to activate its function. Normally, the operator control is located in the cab portion of the vehicle. FIG. 2 shows an illustration of one type of waste collection vehicle, namely a front-end loader 1, with the cab portion designated as 2. Although the following description repeatedly refers to a front-end loader, our invention is equally applicable to all types of waste collection vehicles, including, but not limited to, side loaders, rear loaders, automated residential collection vehicles, roll-off vehicles and vehicles designed for collecting recyclables. It is also preferred that the operator control can be moved in two directions, for example in a forward and backward direction or "UP" and "DOWN" positions. Typically, the operator control will be designed to resemble a "joy stick." Regardless of the specific design of the operator control, it is important that the operator control be in communication with the closed center valve through compressed fluid and a mechanical actuator. The closed center valve is ultimately responsible for directing pressurized hydraulic fluid to various points within the system, including double-acting hydraulic cylinders.

Figure 1:
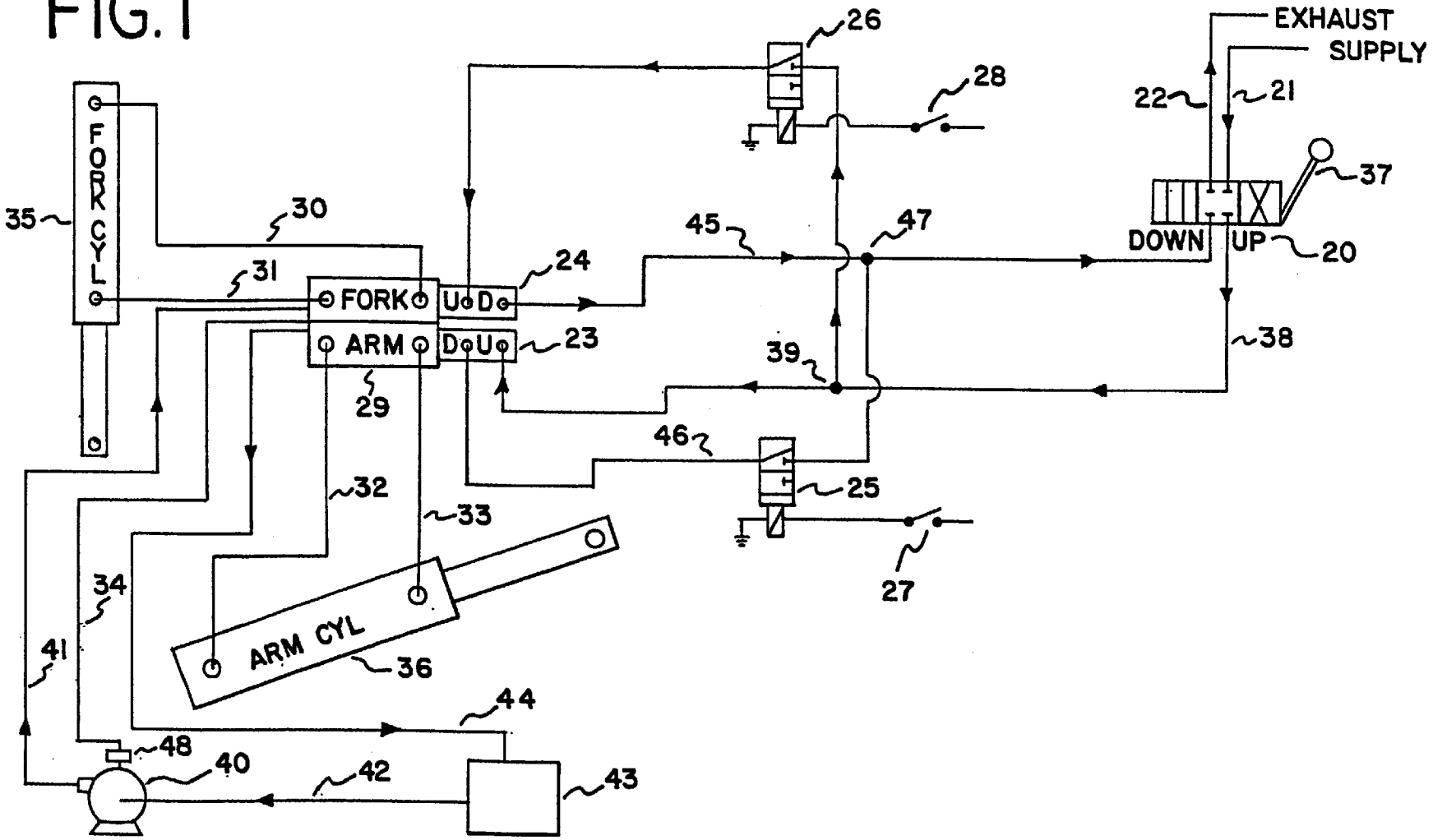
FIG. 1 is a schematic of the hydraulic system of our invention.

Reference to FIG. 1 illustrates a general schematic of the hydraulic system of our invention. More specifically FIG. 1 shows one embodiment of how the operator control 20 is in communication with the closed center valve 29. Joy stick 37 is part of operator control 20 and is designed for operation in two directions, "UP" and "DOWN." When joy stick 37 is moved to the "UP" position, a compressed fluid, for example air, supplied from line 21, is directed through control 20 into line 38 flowing to node 39 where it splits and flows to actuator 23 and air valve 26. Actuator 23 is in mechanical communication with spools in closed center valve 29. The compressed fluid causes actuator 23 to reposition a spool in valve 29 changing the direction of flow of hydraulic fluid through the ports (not shown) causing pressurized hydraulic fluid to flow to and from arm cylinder 36 through lines 33 and 32, respectively, through valve 29. This flow of hydraulic fluid causes cylinder 36 to begin raising the arm(s) and refuse container up and over the vehicle.

The compressed fluid in line 38 after node 39 also flows to valve 26 which is normally closed. Valve 26 opens to allow the compressed fluid to flow to actuator 24 only after receiving a signal from first position sensor 28. Position sensor 28 is activated when the arm and/or refuse container reach a predetermined height. Actuator 24 mechanically causes a spool section (not shown) to change position in valve 29, thus changing the open and closed positions of the ports, and causing pressurized hydraulic fluid to flow to and from cylinder 35 through lines 31 and 30, respectively, through valve 29. This causes cylinder 35 to begin rotation of the refuse container. At this point in time, cylinders 36 and 35 are simultaneously operating on the arm(s) and the refuse container, respectively. Cylinder 36 will continue to operate until it likewise completes it stroke. Cylinder 35 will continue operation until it completes its stroke, thus causing the refuse container to rotate and dump its contents into the hopper. Pump 40 supplies the necessary flow and pressure of hydraulic fluid through lines 42 and 44 in conjunction with fluid reservoir 43. To return the arm(s) and refuse container to the starting position and complete the second phase of the cycle, the vehicle operator moves joy stick 37 to the "DOWN" position. This causes the compressed fluid in line 45 to be released through operator control 20 and exhaust through line 22. This causes actuator 24 to again mechanically change the position of the spool section in valve 29, thus changing the open and closed positions of the ports and causing pressurized hydraulic fluid to flow to and from cylinder 35 through lines 30 and 31, respectively. Cylinder 35 begins its stroke causing the refuse container to reverse direction and rotate up and away from the hopper. At a predetermined point in the reverse rotation of the refuse container the second position sensor 27 is tripped causing valve 25 to open and allowing compressed fluid in line 46 to flow through valve 25, through node 47, through operator control 20 and eventually exhaust through line 22.

When valve 25 is opened, actuator 23 causes a spool in valve 29 to rotate changing the port positions and causing hydraulic fluid to flow to and from cylinder 36 through lines 32 and 33, respectively. At this point in the second phase of the cycle, cylinders 36 and 35 are both in simultaneous operation. Eventually, cylinder 35 will complete its stroke stopping the rotation of the refuse container, while cylinder 36 continues its stroke lowering the arm(s) and refuse container to the starting position.

Traditional hydraulic systems found on conventional waste collection vehicles require high horsepower to push large volumes of oil to large capacity cylinders. Operating pressures are low and the system components are large and heavy. Energy, environment and economic concerns dictate that more efficient designs be developed. The closed center valve used in our invention accomplishes these goals by providing just enough hydraulic fluid flow and pressure applied to the cylinders to do the work. A unique feature of the closed center control valve, as compared to the traditionally used open center valve, is the ability to block all pump fluid flow through the valve when the spool is in the neutral position. Using the prior art open center valve, full pump flow was allowed to travel from the pump, typically a gear pump, through the valve to the hydraulic fluid reservoir. Because the closed center valve is used in conjunction with a variable displacement pump, as opposed to a fixed displacement pump, the pump displacement can be reduced to near zero when all spools are in neutral. When the spool is activated in response to activation of the operator control, the pump begins to stroke (thus producing hydraulic fluid flow) in order to maintain a set hydraulic fluid pressure.

To achieve maximum performance of the system of our invention it is preferred that the closed center valve be able to sense the load being applied to a particular hydraulic cylinder(s) and communicate the load-sense to pump controller 48 which in turn controls the pump to either increase or decrease the hydraulic fluid flow in the system. With the ability to sense the maximum load pressure applied to the various hydraulic cylinders, precise control fluid flow is possible when there are multiple circuits working off one pump. Another feature of the closed center valve is its ability to provide only the amount of hydraulic fluid flow to the work port that is required, regardless of load. The amount of fluid flow delivered is proportional to the percent of spool stroke. The control valve is made up of sections and each section contains a flow control (compensators) featuring a self adjusting variable orifice that maintains a constant flow rate of hydraulic fluid through the valve under changing load conditions. The compensators are located downstream of the valve spool. A preferred closed center valve is the PC 25 which is manufactured and sold by Commercial Intertech.

Another important feature of our invention is the previously mentioned positive displacement pump. This specific type of pump is capable of varying the displacement of the pump per revolution from zero to maximum through built-in mechanical means. The pump output is based on the feedback (load sense signal) received from the closed center control valve. In operation, the pump strives to maintain a constant pressure differential by varying the pump's piston stroke, thus varying the flow of hydraulic fluid flow. The pressure differential between the load-sense signal pressure from the closed center control valve and the pump output pressure is referred to as the margin pressure. Stand-by pressure is the pump output pressure when the control valve is in the neutral position, i.e., no load-sense signal exists. Because the compensator on the pump controls the fluid flow to the valve, a main relief valve is not required. Likewise, when the load is increased, there is no need to increase engine RPM because the pump adjusts the piston stroke and not the speed of the pump. No increase in engine RPM means no increase in the noise level during hydraulic system operation. This of course would reduce the so-called "annoyance factor" as the waste collection vehicle completes its route, especially during residential waste collection. Energy conservation is also achieved because the pump displacement is reduced to near zero when no load-sense exists and thus very little engine horsepower is needed. In contrast, prior art systems using open center valves and gear pumps, fluid flow is continuous, even with no load, and the volume of fluid needed is directly dependent on engine RPM. This relationship is expressed in the following equation:

$$HP=(GPM\times PSI)/1714$$

where:

HP=engine horsepower required

GPM—gallons of fluid flow per minute

PSI—pressure of fluid in pounds per square inch

As previously described, one embodiment of our invention is directed to a method of cycling and dumping a refuse container using a front-end loader vehicle. As mentioned, the combination of a closed-center valve and positive displacement pump makes it possible to perform the cycle without the repetitive stopping and jerking normally encountered using prior art hydraulic systems. Our hydraulic system allows the cycle to be accomplished in a smooth and continuous manner, which results in less garbage spillage and faster cycles. In some cases, our method decreases the dumping cycle time to half that of conventional cycle times. This translates into a cost savings, because shortened cycle times mean quicker route times or alternatively, more locations serviced for a given route time. Because the vehicle cannot be moving during the cycling and dumping of the refuse container, it is highly desirable to minimize the cycle time, thus allowing the truck to increase collection time. Another benefit of our invention is that it is energy efficient and can significantly reduce wear and tear on both the engine and hydraulic system components. This is because the combination of the closed center valve and positive displacement pump delivers hydraulic fluid only when and where needed without the need to increase engine rpm, as required in prior art systems.

Practicing the method of cycling and dumping a refuse container using our invention requires the use of at least two position sensors. One sensor is used during the lifting phase of the cycle and the other sensor is used after dumping during the lowering phase. Additional position sensors may also be used to activate other mechanisms, if desired. Any type of position sensor may be used and the design is not critical to our invention. Likewise the exact location of the position sensors on the vehicle is not critical as long as they are able to sense movement of either the arm(s) and/or the refuse container as they rise or lower during the cycle. The position sensors must, however, be in communication with the closed center valve such that when the first sensor detects the arm(s) of vehicle rising past a predetermined point, a signal is sent to the valve, actuating at least one second hydraulic cylinder which begins rotation of the attached refuse container. A preferred method is to use the position sensor to open a valve to allow compressed fluid to mechanically manipulate an actuator which in turn manipulates the spools in the closed center valve. Likewise, during the second (or lowering) phase of the cycle, the second sensor must be able to detect that the refuse container is rotated past a predetermined point, thus sending a signal to the closed center valve to activate the hydraulic cylinder(s) connected to the arms. Once the cylinder(s) controlling the rotation of the refuse container is activated, the refuse container is continuously rotated, while continuing to raise the arm(s), until the first phase of the cycle is completed and the container is dumped into the hopper located on top of the vehicle. This cycling and dumping is best understood by referring to FIGS. 2 and 3. Refuse container 4 is attached to the front-end loader vehicle through arms 5. The direct connection of the container to the arms is through articulating member 6, shown in the drawings as conventional forks. In a preferred system the articulating member may comprise forks, which removably engage the container similar in nature to how the forks on a forklift engage a pallet. In other circumstances the container is permanently bolted or otherwise attached to the articulating member.

Figure 3:
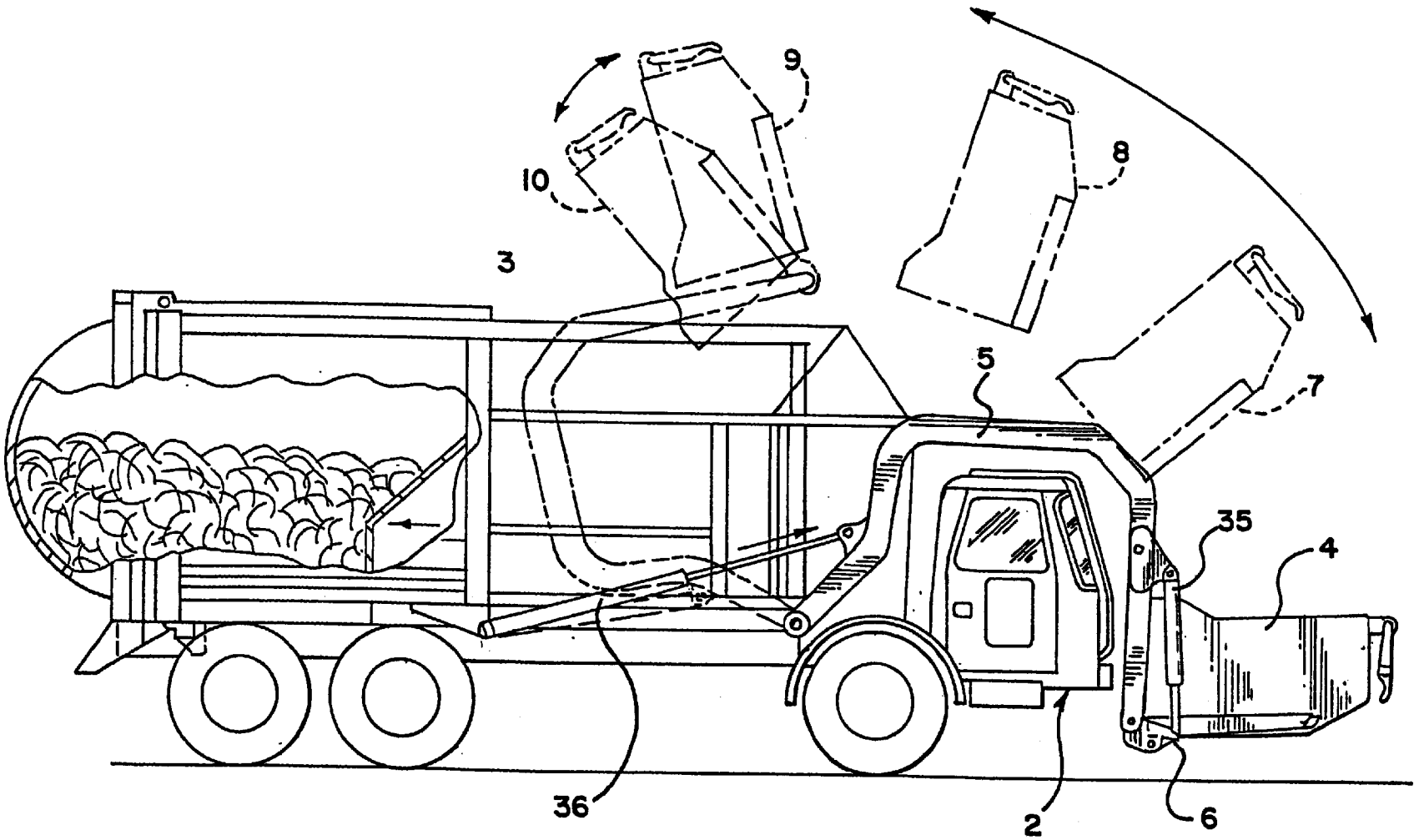
FIG. 3 is a perspective view showing the cycling sequence used to rotate and dump the refuse container.

Upon activation of the operator control, cylinder 36 begins to retract pulling the arms back and up over the cab as illustrated in FIG. 3. As the arms rise up past a predetermined set point, a first position sensor (not shown) detects the movement and causes the actuator to move a spool in the closed valve, which redirects hydraulic fluid flow to cylinder 35 causing the articulating member 6 to rotate the container back and over (see FIG. 3 positions 7–10), dumping its contents into hopper 3. Once the dump is complete, the vehicle operator moves the operator control to a second position which causes cylinder 35 to rotate the articulating member 6 in the reverse direction. This reverse direction causes refuse container 4 to be lifted up and out of its dump position over hopper 3. At a predetermined set point, a second position sensor detects movement of either refuse container 4 or articulating member 6 and sends a signal to a valve (not shown) which in turn allows compressed fluid to flow to an actuator that repositions a spool in the closed center valve. In response, the closed center valve changes the port settings and thus redirects hydraulic fluid to cylinder 36 causing the arm(s) to lower to the starting position, as illustrated in FIG. 2. A unique feature of our invention is that during the complete cycle there are two distinct periods of time when the both cylinders 35 and 36 are in continuous motion. This is in contrast to the prior art methods which typically do not allow for simultaneous operation of the cylinder(s) controlling the arm(s) and rotation of the refuse container. Prior art methods of emptying a refuse container begin by raising the arms to predetermined point them stopping, the cylinders controlling the rotation of the refuse container then begin operation to "level-out" the container. Once the container is level, those cylinders stop and the arm cylinders activate again raising to another predetermined point when then stop and the other cylinders activate to again "level-out" the container. This sequence of starting and stopping is repeated several times until the refuse container is in a position to dumped into the hopper. Not only is this prior art method time consuming, but the constant starting and stopping imparts a jerking motion to the container causing an unacceptable amount of spillage of garbage. Although simultaneous operation of the cylinder(s) that control the arm(s) and rotation of the refuse container is possible using the hydraulic systems of the prior art, the mechanical design of the prior art open center valve found in such systems requires direct operator control of each spool in the valve. This means that the operator must try and manually position the valve spools to cause hydraulic fluid to flow to the cylinders at precise points in time when needed to cause movement of the arms and forks. Manual control is a dangerous practice. For example, if the forks are operated faster than the arms on the up cycle, the waste container can be accidentally rotated into windshield of the cab. Likewise, on the down cycle the forks can be rotated too fast causing the container to come off the forks and land on the roadway in front of the waste vehicle.

Use of the hydraulic system of the present invention, and the attendant methods for waste collection which are provided by it, thus results in numerous advantages, many of which are mentioned above. It will be understood that the invention may be embodied in other specific forms without departing from its spirit or central characteristics. The present examples and embodiments, therefore, are to be considered in all respects as illustrative and not restrictive, and the invention is not to be limited to the details given here.

We claim:

1. A method of operating a hydraulic system in a side loading waste collection vehicle comprising, in combination, a) providing an engine in a side loading waste collection vehicle having a varying RPM that is mechanically connected to a fixed displacement pump having a variable piston stroke;

b) activating an operator control in communication with a closed center valve having one or more valve spools, where the closed center valve prevents flow of hydraulic fluid through the valve when the spools are in a neutral position;

c) changing position of at least one valve spool from a neutral position in response to activating the operator control and causing hydraulic fluid to flow to at least one hydraulic cylinder;

d) pressurizing hydraulic fluid by increasing the stroke of the fixed displacement pump in response to a signal received from a pump controller in fluid communication with the closed center valve, where the pump stroke is increased without increasing engine RPM;

e) sensing a load applied to the at least one hydraulic cylinder and transmitting the sensed load to the pump controller;

f) increasing or decreasing the piston stroke of the pump independently of engine RPM to change volumetric hydraulic fluid flow in response to the sensed load transmitted to the pump controller; and g) destroking the pump to reduce the volumetric hydraulic fluid flow to achieve stand-by pressure when no load on the at least one hydraulic cylinder is sensed or the valve spools are in a neutral position.

2. A method of operating a hydraulic system in a rear loading waste collection vehicle comprising, in combination, a) providing an engine in a rear loading waste collection vehicle having a varying RPM that is mechanically connected to a fixed displacement pump having a variable piston stroke;

b) activating an operator control in communication with a closed center valve having one or more valve spools, where the closed center valve prevents flow of hydraulic fluid through the valve when the spools are in a neutral position;

c) changing position of at least one valve spool from a neutral position in response to activating the operator control and causing hydraulic fluid to flow to at least one hydraulic cylinder;

d) pressurizing hydraulic fluid by increasing the stroke of the fixed displacement pump in response to a signal received from a pump controller in fluid communication with the closed center valve, where the pump stroke is increased without increasing engine RPM;

e) sensing a load applied to the at least one hydraulic cylinder and transmitting the sensed load to the pump controller;

f) increasing or decreasing the piston stroke of the pump independently of engine RPM to change volumetric hydraulic fluid flow in response to the sensed load transmitted to the pump controller; and g) destroking the pump to reduce the volumetric hydraulic fluid flow to achieve stand-by pressure when no load on the at least one hydraulic cylinder is sensed or the valve spools are in a neutral position.

3. A method of operating a hydraulic system in a waste collection vehicle designed to collect recyclables comprising, in combination, a) providing an engine in a waste collection vehicle designed to collect recyclables having a varying RPM that is mechanically connected to a fixed displacement pump having a variable piston stroke;

b) activating an operator control in communication with a closed center valve having one or more valve spools, where the closed center valve prevents flow of hydraulic fluid through the valve when the spools are in a neutral position;

c) changing position of at least one valve spool from a neutral position in response to activating the operator control and causing hydraulic fluid to flow to at least one hydraulic cylinder;

d) pressurizing hydraulic fluid by increasing the stroke of the fixed displacement pump in response to a signal received from a pump controller in fluid communication with the closed center valve, where the pump stroke is increased without increasing engine RPM;

e) sensing a load applied to the at least one hydraulic cylinder and transmitting the sensed load to the pump controller;

f) increasing or decreasing the piston stroke of the pump independently of engine RPM to change volumetric hydraulic fluid flow in response to the sensed load transmitted to the pump controller; and g) destroking the pump to reduce the volumetric hydraulic fluid flow to achieve stand-by pressure when no load on the at least one hydraulic cylinder is sensed or the valve spools are in a neutral position.

* * * * *